US010563960B2

(12) United States Patent
Carton

(10) Patent No.: US 10,563,960 B2
(45) Date of Patent: Feb. 18, 2020

(54) ARMOUR SYSTEM WITH PROJECTILE YAW ANGLE GENERATING LAYER

(71) Applicant: Nederlandse Organisatie voor toegepast—natuurwetenschappelijk onderzoek TNO, The Hague (NL)

(72) Inventor: Erik Peter Carton, The Hague (NL)

(73) Assignee: Nederlandse Organisatie voor toegepast—natuurwetenschappelijk onderzoek TNO, The Hague (NL)

( * ) Notice: Subject to any disclaimer, the term of this patent is extended or adjusted under 35 U.S.C. 154(b) by 0 days.

(21) Appl. No.: 15/566,128

(22) PCT Filed: Apr. 13, 2016

(86) PCT No.: PCT/NL2016/050258
§ 371 (c)(1),
(2) Date: Oct. 12, 2017

(87) PCT Pub. No.: WO2016/167654
PCT Pub. Date: Oct. 20, 2016

(65) Prior Publication Data

US 2018/0087877 A1 Mar. 29, 2018

(30) Foreign Application Priority Data

Apr. 13, 2015 (EP) ..... 15075023

(51) Int. Cl.
*F41H 5/007* (2006.01)
*F41H 5/04* (2006.01)

(52) U.S. Cl.
CPC ..... *F41H 5/007* (2013.01); *F41H 5/0407* (2013.01); *F41H 5/0428* (2013.01); *F41H 5/0457* (2013.01)

(58) Field of Classification Search
CPC ..... F41H 5/04; F41H 5/0407; F41H 5/007; F41H 5/0428; F41H 5/0457; F41H 5/0478
(Continued)

(56) References Cited

U.S. PATENT DOCUMENTS 3,649,426 A * 3/1972 Gates, Jr. ..... E04B 1/62 428/68
3,896,758 A * 7/1975 Di Battista ..... B64G 1/56 116/201
(Continued)

FOREIGN PATENT DOCUMENTS

WO 2007/066059 A1 6/2007
WO WO-2007066059 A1 * 6/2007 ..... F41H 5/04
(Continued)

*Primary Examiner* — John Cooper
(74) *Attorney, Agent, or Firm* — Banner & Witcoff, Ltd.

(57) ABSTRACT

The invention relates to an armoured object having one or more sides that are at least partially formed of a layered armouring system comprising at least an inner layer and an outer layer (which—at least during use—is closer to a strike face than the inner layer), which inner layer is a projectile-resisting layer having an E-modulus of 1 GPa or more, and the outer layer is a projectile-destabilising layer having a lower E-modulus than the projectile-resisting layer, which projectile-destabilising layer has a Hooke number ($\rho \cdot v^2/E$) of at least 1.0 at a velocity (v) of 800 m/sec.

21 Claims, 2 Drawing Sheets

(58) Field of Classification Search
USPC ..... 89/36.01, 36.02, 36.04, 36.05
See application file for complete search history.

(56) References Cited

U.S. PATENT DOCUMENTS 4,194,431 A * 3/1980 Markus ..... F41H 5/007 109/84
4,664,967 A * 5/1987 Tasdemiroglu ..... B32B 15/14 428/220
5,217,185 A * 6/1993 Rucker ..... B64G 1/58 244/121
5,518,806 A * 5/1996 Eder ..... B29C 44/5636 181/288
6,298,765 B1 * 10/2001 Dvorak ..... B64G 1/56 89/36.02
6,712,318 B2 * 3/2004 Gubert ..... B64G 1/56 244/121
6,899,009 B2 * 5/2005 Christiansen ..... E06B 9/00 89/36.02
7,827,897 B2 * 11/2010 Magnusson ..... F41H 5/0492 89/36.02
8,046,845 B1 * 11/2011 Garcia ..... A42B 3/061 2/2.5
8,590,437 B2 * 11/2013 Gettle ..... F41H 5/0442 89/36.02
2001/0037622 A1 * 11/2001 Gattas ..... E04B 2/7401 52/745.09
2001/0053645 A1 * 12/2001 Henderson ..... B32B 5/28 442/135
2010/0320693 A1 * 12/2010 Kovanetz ..... C08L 23/10 273/410
2011/0239851 A1 * 10/2011 Mason ..... B32B 27/04 89/36.02
2011/0308381 A1 * 12/2011 Hartley ..... F41H 5/0407 89/36.02
2017/0368784 A1 * 12/2017 Konyu ..... B32B 3/18

FOREIGN PATENT DOCUMENTS

WO 2011/103614 A1 9/2011
WO WO-2016167654 A1 * 10/2016 ..... F41H 5/007

* cited by examiner

ARMOUR SYSTEM WITH PROJECTILE YAW ANGLE GENERATING LAYER

RELATED APPLICATION DATA

This application is a National Stage Application under 35 U.S.C. 371 of co-pending PCT application number PCT/NL2016/050258 designating the United States and filed Apr. 13, 2016; which claims the benefit of EP application number 15075023.0 and filed Apr. 13, 2015 each of which are hereby incorporated by reference in their entireties.

The present invention relates to an armoured object, to a layered armouring system, to a method for protecting a living being or a thing against damage by a bullet or other projectile, and to the use of a projectile-destabilising material.

Armour materials, in particular materials used as an antiballistic material, as known in the art, generally have a high resistance against high velocity impact against bullets and/or other missiles. It is generally considered important in the art to provide a material with a high strength and a high Young's modulus (E-modulus), i.e. a high stiffness.

Armouring materials may be made of glass, ceramics, metals, polymer fibres or combinations thereof. The materials are generally designed to slow down the impacting projectile (such as a bullet) while being penetrated.

Transparent armour systems can be made of glass and/or polymers and are usually made of multiple layers of material having a hard frangible plate backed by one or more transparent tough resilient plates, bonded together by a suitable adhesive. Thus, a transparent armour can be provided, e.g. as described in United States Statutory Invention Registration H1567 (application number 667,624). Another laminated armour is described in United States Statutory Invention Registration H1519 (application number 522,788).

Glass/polymer armour materials are usually not very effective against relatively heavy ammunition, unless they are relatively thick. Further, conventional laminated glass armour has a high tendency of lateral tearing or bursting upon impact of a bullet or other projectile. Accordingly, it offers limited "multi-hit" protection (protection against impact of a plurality of projectiles). As a result, laminated armour generally needs to be very thick, and therefore rather heavy, to provide a given level of antiballistic protection.

Ceramic armour materials (e.g. spinel, ALON, Sapphire) tend to be much harder and/or stiffer than conventional glass materials and polymeric materials. In addition to slowing down the impacting projectile they may strongly erode the projectile. However, ceramic armour materials are usually more difficult to form into articles of a complex shape (such as curved shapes) or large articles than armour glasses or polymers. Further, they tend to be expensive. Moreover, they have a high density, which adds to the weight. Furthermore, ceramics, like conventional laminated glass materials, tend to have a relatively low multi-hit capacity. A method to improve multi-hit capacity (of windows) is described in WO 2008/051077. Herein a polymer layer, in particular a viscoelastic material, is attached to a window, to the side of the window facing a way from the strike face.

There remains a need for alternative armour systems in general, because of the diversity in potential threats (kind of projectile) and the diversity in circumstances (mobile, non-mobile; civilian or military threats, etc., need for transparent materials or not). In particular, there remains a need for an alternative armour that offers satisfactory protection against one or more kinds of projectiles, especially against an armour piercing (AP) projectile, more in particular an armour piercing bullet, wherein the thickness and/or weight of the material is relatively low and/or wherein the material is transparent. In particular, for use in a vehicle, there is not only a desire for relatively low weight and/or thin material that are transparent but also for such materials that are not transparent. In these respects armour is different from so called bullet-trapping devices, which are typically relatively small static devices to catch bullets at a shooting range, rather than provide protection against (unknown) threats.

The inventors have now surprisingly found that it is possible to provide such alternative by providing a layered armour material comprising a projectile-resisting layer and a further layer with a specific property, facing the strike face (relative to the projectile-resisting layer).

Accordingly, the present invention relates to a layered armouring system comprising a projectile-resisting layer and a projectile-destabilising layer, the projectile-resisting layer having a E-modulus that is higher than the E-modulus of the projectile-destabilising layer, and the projectile-destabilising layer having a Hooke number ($\rho \cdot v^2/E$) or (in case of a fluid destabilising layer) a Cauchy number ($\rho \cdot v^2/K$), of at least 1.0 at a projectile velocity (v) of 800 m/sec, of which projectile-destabilising the E-modulus is lower than the E-modulus of the projectile-resisting layer. Typically, at least during use, the projectile-resisting layer is closer to the side to be protected than the projectile-destabilising layer. Thus, the projectile-destabilising layer is impacted upon first if a projectile impacts on the strike face of the armour, and only thereafter on the projectile resisting layer.

Further, the invention relates to an armoured object having one or more sides that are at least partially formed of a layered armouring system comprising at least an inner layer and an outer layer, which inner layer is a projectile-resisting layer and the outer layer is a projectile-destabilising layer, wherein the projectile-resisting has an E-modulus that is higher than the E-modulus of the projectile-destabilising layer, and which projectile-destabilising layer has a Hooke or Cauchy number of at least 1.0 at a projectile velocity (v) of 800 m/sec.

Further, the invention relates to a method for protecting a living being, in particular a human or a thing, from damage by a bullet or another projectile, wherein the layered armouring system according to the invention or the layered armouring system of an object according to the invention is positioned between the living being or thing and the projectile or the direction from which the risk of impact by the projectile is expected.

The invention further relates to the use of a projectile-destabilising material having a Hooke or Cauchy number of at least 1.0 at a projectile velocity (v) of 800 m/sec to increase the yaw-angle or angular velocity of a bullet impacting on an bullet resisting structure.

Figure 1A:
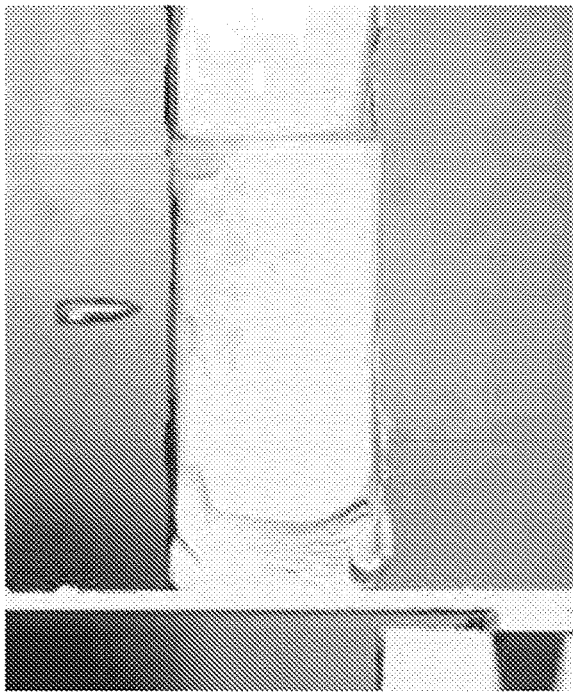
FIGS. 1A-B illustrate a bullet just before and just after impact with a clay block.

Armour materials generally have a protected side (a side facing a living being or thing that is to protected from the impact by a projectile) and a strike face, i.e. the side from which an impact by a projectile is considered to be most likely during normal use. In case the armouring system is an armouring of a vehicle, a building or another object with an inner space to contain a living being or thing to be protected, the strike face is typically the outer side of the object, and thus the terms 'inner layer' and 'outer layer' are used to define the position of the layers relative to the protected side. In other words, the projectile-destabilising layer (outer layer) will be closer to the strike face, and the projectile-resisting layer closer to the protected side.

Although possible, said outer layer does not need to be the outermost layer of the material, and said inner layer does not need to be the innermost layer of the material.

The term "or" as used herein is defined as "and/or" unless it is specified otherwise or it follows from the context that it means "either . . . or . . . ".

The term "substantial(ly)" or "essential(ly)" is generally used herein to indicate that it has the general character or function of that which is specified. When referring to a quantifiable feature, these terms are generally used to indicate that it is for more than 50%, in particular for at least 75%, more in particular at least 90%, even more in particular at least 95% of the maximum that feature.

The term "a" or "an" as used herein is defined as "at least one" unless it is specified otherwise or it follows from the context that it should refer to the singular only.

When referring to a noun (e.g. a compound, an additive, etc.) in the singular, the plural is meant to be included, unless it follows from the context that it should refer to the singular only.

When referring to a physical state of matter of a material (such as fluid, solid, plastic) generally this relates to the state of the material at ambient conditions, in particular at 25° C.

Where the terms "comprise", "comprises", "comprised" or "comprising" are used in this specification (including the claims) they are to be interpreted as specifying the presence of the stated features, integers, steps or components, but not precluding the presence of one or more other features, integers, steps or components, or group thereof. In line with this (commonly accepted) meaning of these terms, these terms also include the meaning "contain", "contains", "contained" respectively "containing" and "consist of", "consists of", "consisted of" respectively "consisting of".

In the context of this application, the term "about" means in particular a deviation of 10% or less from the given value, more in particular 5% or less, even more in particular 3% or less.

For the purpose of clarity and a concise description features are described herein as part of the same or separate embodiments, however, it will be appreciated that the scope of the invention may include embodiments having combinations of all or some of the features described.

In the equation 'Hooke number=$\rho \cdot v^2/E$', the density of the projectile-destabilising layer, $\rho$, is given in $kg/m^3$; the projectile velocity, v, is given in m/s and Young's modulus of the projectile-destabilising layer, E, is given in $kg/m \cdot s^2$, whereby the Hooke number is a dimensionless quantity (Transport Phenomena Data Companion L. Janssen and M Warmoeskerken, DUM ISBN 0-7131-3618-9). For fluids (lacking a significant E-modulus, and thus E-modulus will be (close to zero)) Hooke number will approximate infinity. For fluids, the Cauchy number may be used to distinguish in properties of the layer. 'Cauchy number=$\rho \cdot v^2/K$', wherein K is the compressibility modulus (K-modulus)

As used herein, Young's modulus E (E-modulus or storage modulus for polymers and elastomeric materials), respectively the K-modulus is the respective modulus, as measured at 20° C. by Dynamic Mechanical Analysis (DMA) at 1 Hz.

Figure 1B:
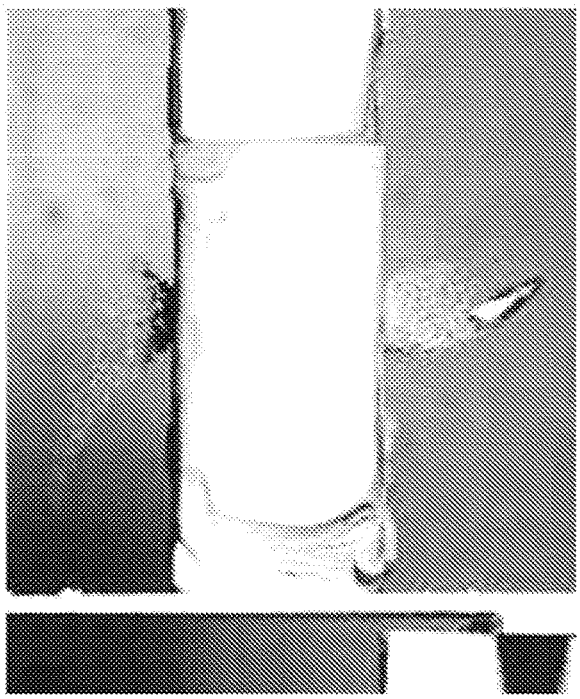

It is the inventor's finding, in breach with the general desire to use stiff materials to improve antiballistic properties, that an outer layer with a low stiffness, or even without any significant stiffness, such as water, is effective in improving the antiballistic properties of an armour. Without being bound by theory, this surprising positive effect is explained by the destabilising effect the material with a large Hooke number has on the yaw-angle or yaw-rate (angular velocity) of an impacting projectile, such as an armour piercing bullet. The effect on the yaw-angle is illustrated in the Example, and in particular in FIGS. 1A and 1B. FIG. 1A shows a bullet just before impact on the destabilising layer (a clay block). It approaches the layer (vertically positioned) essentially perpendicular to the layer (horizontally). FIG. 1 B shows the same bullet just after leaving the layer. The yaw-angle has changed by about 30°. Velocity of the bullet was also monitored, there was no substantial reduction in bullet velocity (see table in Examples). The effectivity of the projectile-resisting layer which can be placed attached to the outer layer or at a distance, is strongly increased with the increase in yaw-angle (not shown). Thus, the projectile-destabilising layer has in particular a tumbling effect on the projectile.

An armouring system according to the invention is in particular suitable to provide protection from impact by a bullet, more in particular an armour piercing bullet. Armour piercing projectiles are designed to penetrate armour, e.g. a bulletproof window, an armoured vehicle or an armoured building. Accordingly, the projectile-resisting layer typically is a bullet-resisting material and the projectile-destabilising layer typically is a bullet-destabilising material. The invention in particular provides an armouring system suitable to provide protection against armour piercing bullets or other kinetic energy projectiles.

An armouring system according to the invention is also suitable to provide protection from a ball-type bullet. Thus, the invention is in particular advantageous in that offers protection against distinct classes of projectiles.

The projectile-destabilising layer is arranged to destabilise an impacting projectile of interest, such as an armour piercing pierce—preferably at least a Stanag 4569 level 3 armour piercing projectile—or a ball-type bullet, in particular to change its yaw angle. The projectile-destabilising layer typically a material with a low stiffness or no significant stiffness. The projectile destabilising material/layer usually has an E-modulus of about 1 GPa or less, in particular 0-0.7 GPa, preferably 0.01-0.5 GPa. A relatively low E-modulus is in particular preferred for increased yaw-effect and for that reason it is particularly preferred that the E-modulus is about 0.3 GPa or less, more in particular about 0.1 GPA or less is particularly preferred. LDPE is an example of a material typically with an E-modulus of about 0.3 GPa. Ballistic clay (Roma Nr 1) has an E-modulus of about 0.1 GPa. Also a low E-modulus allows the use of materials with a relatively high Hooke number, yet a low density, thereby providing a light weight armour, especially if the material is a solid not requiring a special container to be contained in (see below). This is in particular important for mobile armoured objects, since heavy weight and bulky armoured systems are undesired for such objects, in particular because they hamper mobility.

The higher the E-modulus, the higher the stiffness, and thus the better the structural integrity is maintained during (normal, e.g. daily) use (absent of impact by projectiles), as materials with no or an insignificant E-modulus show fluid, visco-fluid behaviour or are easily deformed by plastic deformation, and may thus be easily damaged by e.g. an eroding effect of wind, sand, water or scratching. A fluid, visco-fluidic material or soft-solid material (plastic material, malleable material, gel) may still be used, in particular if provided with adequate protection, e.g. a coating (for non-fluid material) or by being placed in a container. In view of these considerations, an E-modulus of at least about 0.02 GPa, is particularly preferred. A higher E-modulus, such as of about 0.3 GPa makes the material more resistant against erosion, scratching and other wearing effects, but this reduces the Hooke number, hence the bullet destabilizing effect.

From a viewpoint of having a high effectivity with respect to destabilising the bullet, the density is preferably relatively high; however, if it is desired to offer a relatively low-weight solution, a material with a relatively low density may be chosen. Generally, the density of the material will be at least about 200 kg/m$^3$, in particular at least about 500 kg/m$^3$, preferably at least about 700 kg/m$^3$, more preferably at least about 900 kg/m$^3$. Usually, the density is less than 2000 kg/m$^3$, in particular about 1500 kg/m$^3$, more in particular about 1200 kg/m$^3$ or less.

The Hooke number or Cauchy number of the projectile destabilising layer is at least 1.0, in particular 2.5 or more, preferably at least 5. The upper limit is not particularly critical; as illustrated by the Example, a material with no E-modulus (water) is effective, and thus in principle Hooke number of the projectile destabilising layer can approach infinity. In practice, it is usually preferred to provide a material which is dimensionally stable in the absence of external forces (other than gravity), i.e. that it is non-fluidic. Such materials typically have an E-modulus above 0, in particular of about 100 MPa or more. Accordingly, in practice Hooke number, may approximate infinity; be up to about 1000, up to about 100 or up to about 10, depending upon considerations like the relative importance of dimensional stability, weight of the armouring material, desired degree of protection. Analogously the Cauchy number may be up to about 1000, up to about 100 or up to about 10. Illustrative figures for a Hooke number of polycarbonate (E-modulus 2.3 GPa) is 0.34, i.e. this is a material not suitable as the destabilising layer. LDPE has a Hooke number of about 2.7. Ballistic clay (Roma Nr1) has a Hooke number of about 8, both LDPE and ballistic clay are suitable as destabilizing layer.

In principle, the projectile-destabilising material can be selected from a wide variety of materials. The projectile-destabilising material is arranged in the layered armour system to destabilise the impacting projectile of interest, such as an armour piercing pierce—preferably at least a Stanag 4569 level 3 armour piercing projectile—or a ball-type bullet rather than to trap it inside the material. As illustrated in FIGS. 1A and 1B a fluid (contained in a chamber) is effective. Water is particularly favourable for its transparency, in case a transparent material is required, and because of its non-flammability and low density. A benefit of a fluid may in a specific embodiment also reside in the possibility to remove the fluid at times when protection is not needed. An armouring with a fluid as destabilising layer can be provided by providing a space between a first layer of a solid fluid-proof material (glass, polymer, metal, ceramic or other) and a second layer of the same or a different solid fluid-proof material. The outer layer of these two can be a conventional material suitable as an outermost layer for the armoured object that is at least partially made of the armouring material, e.g. conventional transparent polymer or glass for a window of a building or vehicle, if the armouring material is or forms part of a window, or a conventional construction metal (e.g. steel, aluminium, titanium) for a vehicle that is armoured with an armouring material of the invention, or a conventional construction plastic, wood or ceramic of a building armoured with an armouring material of the invention. The inner layer of these two fluid-proof materials can be of the same or a different material. In particular, it can be the projectile-resisting material. If use is made a fluid projectile-destabilising layer, care is taken that the material does not unacceptably shrink or expand within the temperature range at which the armouring system is intended to be used. E.g. if water is used, the armouring system is typically used at a temperature above 0° C. or a antifreeze agent is added, e.g. a salt, alcohol (ethanol, propanol, glycerol), alkylene glycol (PEG, PPG), Advantageously, the projectile-destabilising material, is an essentially solid material, i.e., unlike fluids, it maintains shape in the absence of externally applied forces. It may be a plastic material, such as a paste, a wax or a gel.

Gels are nonfluid colloidal networks or polymer networks that are expanded throughout their whole volume by a fluid, such as water or an organic fluid. Many gels of synthetic polymers are known. For instance, the projectile destabilising layer may be a gel of one or more polymers selected from the group of poly(lactams), in particular polyvinylpyrrolidones; polyurethanes; homo- and copolymers of acrylic and methacrylic acid; polyacrylamides; polyvinyl alcohols; polyvinylethers; maleic anhydride based copolymers; polyesters; vinylamines; polyethyleneimines; polyalkylene oxides, in particular polyethylene oxides (PEO/PEG), polypropylene oxides (PPO/PPG); poly(carboxylic acids); polyamides; polyanhydrides; polyphosphazenes; polysaccharides, in particular, gums, cellulosics, chitosans, hyaluronic acids, alginates, chitins, heparins, dextrans; chondroitin sulphates; (poly)peptides/proteins, in particular collagens, fibrins, elastins, albumin, gelatin; polyesters, in particular polylactides, polyglycolides; polylactones, such as polycaprolactones; silicones, polyacrylamides and polyvinyl alcohols. A well known example of gels is (ballistic) gelatin. Further, e.g. polyacrylamide gels; silicone gels; acrylate polymer gels, e.g. hydroxyalkyl(meth)acrylate gels (e.g. polymacon); polysaccharide gel; polyvinyl alcohol gels. Polysaccharides with good gelling properties include in particular alkylated, ionic and/or hydroxylated polysaccharides, such as methyl cellulose, carboxymethyl cellulose, hydroxymethylcellulose, hydroxyethylcellulose, hydroxypropylcellulose and alginates.

Waxes are relatively large organic molecules (>C20, in particular C25-C120, more in particular C30-C100) that are generally non-fluid yet plastic (malleable) at about 25° C. Waxes usually at least substantially consist of one or more compounds selected from the group of alkanes, sterols, substituted or non-substituted naphtenes, and esters of carboxylic acid and long chain alcohols. In particular, one or more compounds selected from the group of alcohols, ketones and aldehydes, fatty acids may also be present. A wax is usually selected from the group of plant waxes, animal waxes, mineral & petroleum waxes (obtained from oil,coal or other fossil sources) and synthetic waxes. Plant waxes include carnauba wax, candililla wax, ouricury wax, soybean wax, palm wax, castor wax, rice bran wax, tallow tree wax, jojoba, Japan wax, esparto wax and baybury wax. Animal waxes include bees wax, shellac, Chinese wax, lanolin and tallow. Paraffin waxes, microcrystalline wax and petroleum jelly are examples of petroleum waxes; montan waxes, ozocerite and peat waxes are examples of mineral waxes. Polyethylene waxes (cracked polyethylene), Fischer-Tropsch waxes, metallocene polyolefin waxes and substituted amide waxes are examples of synthetic waxes. Stearin wax is an example of a wax that can e.g. be derived from a plant or animal.

Clays (in wet form, mixed with water or oil, such as modelling clay, ballistic clay) form another group of materials that can be used as projectile-destabilising material. The clay in an armouring system is typically in a plastic (malleable) form), i.e. non-sintered. The clay is usually selected from the group of water-based clays, oil-based clays (both comprising mineral clay) and polymer clays.

Advantageously, the projectile-destabilising layer comprises one or more polymers selected from the group consisting of acrylonitrile-butadiene-styrene; acetal resins; cellulose derivatives, in particular cellulose esters, such as cellulose acetate, cellulose butyrate, cellulose propionate, cellulose triacetate and alkyl celluloses, such as ethyl cellulose; acrylics; allyl resins; polyethers, in particular chlorinated polyethers; fluoroplastics; melamines; polyamides (e.g. nylon); parylene polymers; phenolics; phenoxy resins; polycarbonates; polyesters; polyolefines, in particular polyethylenes (PE); polypropylenes (PP); polybutylene; polyphenylenes; polystyrenes; polyurethanes; polyureas; polysulphones; polyvinyl alcohols; polyvinyl fluorides; polyvinyl butyrals; polyvinylidene chlorides; silicones; styrene acrylonitrides; styrene butadiene; polyvinylchlorides (PVC); polylactams; including copolymers of any of these. Preferred polymers include low density polyethylene (LDPE; typically having a density of 910-940 kg/m$^3$), polyurethanes and, silicone polymers, e.g. Sylgard®. Within each of these classes, polymeric materials with a desired E-modulus are commercially available or can routinely be prepared. By including plasticizers, E-modulus of a specific polymer can be reduced, as is generally known in the art.

The polymers can be provided in a transparent form or non-transparent form, as desired. The polymers do not inherently have a Hooke number as required by the present invention. The skilled person will be able to select a polymer with a suitable Hooke number, based on common general knowledge and the information disclosed herein. E.g. high density and low density varieties of polymers, e.g. PE or PP, are known. As a rule of thumb, E-modulus can be increased by increasing crosslink degree and by a high molecular weight. Thus, for a low E-modulus, it is generally preferred to use non-crosslinked or only lowly crosslinked polymers and/or to select a polymer with a relatively low molecular weight.

In a preferred embodiment the projectile-destabilising layer is an elastomeric material or a visco-elastic material, preferably a visco-elastic or elastomeric polymer.

A specific advantage of a visco-elastic material is that it may show a 'self-healing' effect, i.e. a hole initially caused by the impact of a projectile reduces in size or is completely filled again with the material, some time after the impact.

Specific material properties, such as elasticity, visco-elasticity, hardness, may be controlled by the choice of components and ratio from which the layer is composed, such as chemical structure and average polymer weight of the polymer and/or the presence of a cross-linking agent.

Usually, the projectile-destabilising layer is made of a single material, preferably a monolithic material. This is advantageous especially in case of a transparent armouring material. Further, it maintains simplicity of design. However it is also possible to provide a layered structure of materials with a Hooke number of 1.0 or more or to provide a layer of composite material with a Hooke number of 1.0 or more.

The projectile-destabilising layer usually has a thickness of 5 mm or more, preferably of 10 mm or more, more preferably of 20 mm or more, in particular of at least 40 mm, e.g. about 60 mm or more. A higher thickness is advantageous for increasing the effect on yaw-angle. The higher the kinetic energy of the projectile against which protection is desired, the higher thickness is desired. However, a higher thickness will add to weight and bulkiness of the armouring. It is further contemplated that the higher Hooke number, the lower the thickness that is needed to create a certain change in yaw-angle or yaw-rotation (if other factors are kept the same). In particular for protection against level 3 armour piercing projectiles (according to STANAG 3), a thickness of about 200 mm or less is usually sufficient, although a higher thickness may be chosen, in particular to achieve more efficient protection against higher level impacts. A minimally required thickness for a desired level of protection can empirically be determined on the basis of the information disclosed herein, the cited literature and common general knowledge, based on the materials of choice. Preferably, the thickness is about 150 mm or less, in particular about 100 mm or less.

Due to their lack of stiffness, it is generally desired that the projectile-destabilising material, also if it is a solid material, is protected from the environment by a protective layer. This can be a solid fluid-proof material, as described above when describing the use of a fluid as a projectile-destabilising material. In principle it does not need to be fluid-proof, but in general it is preferred that the material also protects the projectile-destabilising layer against the negative influence of water (from the environment, e.g. rain). The container material can have a conventional surface finish of glass, metal, ceramic or polymer. The container material can be relatively thin, compared to the projectile destabilizing layer. It usually has a thickness of less than 5 mm, in particular about 2 mm or less, e.g. of about 0.1 to about 1 mm.

The projectile-resisting layer can in principle be made of any material suitable for construction of an object that is to be armoured with an armouring material of the invention. Thus it can be part of an existing object that is provided with a projectile-destabilising material, or an object can be newly produced using an armour according to the invention, or using a projectile-resisting material to form a projectile-resisting layer and a projectile-destabilising material to form a projectile-destabilising layer of the object that is produced.

The projectile-resisting layer does not need to be an armouring material itself, although this may be advantageous, given the fact that the projectile-destabilising layer does not necessarily reduce the velocity of the impacting projectile substantially, and thus at least in case of a desired protection against relatively heavy impacts, the use of an armouring material can be beneficial. Thus, in an embodiment, the projectile-resisting layer is an armouring material, for instance as described in the cited prior art.

Of the materials, having a sufficiently high stiffness to be good projectile-resisting materials, suitable polymeric materials used as projectile resisting materials generally have an E-modulus in the lower GPa range, usually in the range of about 1 to about 3 GPa; e.g. an exemplary polycarbonate has an E-modulus of about 2.3 GPa. The E-modulus of a layer comprising the polymeric material can be increased by including a fibrous material, e.g. glass or carbon fibres, to obtain a composite. This is in particularly useful for non-transparent applications. Metals generally have an E-modulus in the range of about 40 to about 200 GPa, with magnesium being a metal with a relatively low E-modulus of about 44 GPa. An exemplary glass has an E-modulus of about 65 GPa. Ceramics have a particularly high E-modulus, typically about 200 to about 700 GPa. Thus, in general, the projectile-resisting material/layer as an E-modulus of 1 GPa or more, in particular up to 700 GPa. Preferably the E-modulus of the projectile-resisting material/layer, e.g. glass, metal, polymeric or a composite thereof, is 1.2-200 GPa, more in particular 1.5-150 GPa, more in particular 2 to 100 GPa. The E-modulus of a metallic projectile-resisting layer, preferably is in the rang of 70-100

In particular, in case the projectile-resisting layer is made of a transparent material other than a transparent ceramic and/or if the projectile-resisting layer comprises a polymeric material and/or a glass material, the E-modulus usually is below 100 GPa, in particular up to about 70 GPa for a full glass layer. For a polymeric layer, an E-modulus usually in the range of 1-20 GPa; an E-modulus in the range of 1.2-15 GPa, in particular in the range of 1.2 to 10 GPa, more in particular in the range of about 2 to about 5 GPa, more in particular in the range of about 2 to about 3 GPa is specifically preferred.

Considering the typical E-modulus of at least 1 GPa, the Hooke-number of the projectile resisting layer will generally be below 1, in particular about 0.5 or less.

In a preferred embodiment, the projectile-resisting layer is made of a material selected from the group of a laminated polymeric materials such as a PC-PMMA laminate and laminated composite material formed of polymer sublayers and glass sublayers. Such materials are readily available as transparent products, and thus these are eminently suitable for applications wherein transparency is desired, e.g. in windows, such as windows of a vehicle or a building. Further, these materials are available in relatively low density, especially if the polymer content is high, or if they are fully polymeric.

In a further preferred embodiment, the projectile-resisting layer is a metal layer, in particular a metal layer made from armour plate (steel), aluminium, titanium, uranium (depleted). This is particularly useful for protection of transports, such as vehicles, aircrafts or naval vessels. Further, this is useful in the protection of safes.

The projectile-resisting layer usually has a thickness of at least 2 mm, preferably of at least 5 mm, in particular of at least 10 mm. In principle, the projectile-destabilising layer can be provided to an object having a projectile resisting layer of any thickness. In practice, the thickness will generally be less than 1 m, in particular less than 200 mm, preferably 100 mm or less, more preferably 75 mm or less. In particular, for significant protection against a bullet of level 3 up to such thickness is usually sufficient. In particular, in mobile applications (e.g. transports) preferably, the thickness is about 50 mm or less, more preferably about 30 mm or less.

Figure 2A:
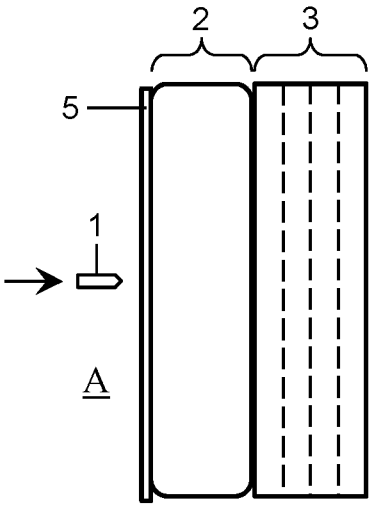
FIGS. 2A-C illustrate the travel path of a projectile through a layered armour system having a protective layer, an outer layer and an inner layer.
Figure 2B:
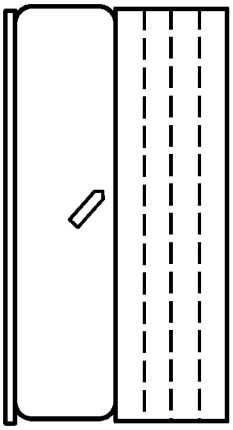
Figure 2C:
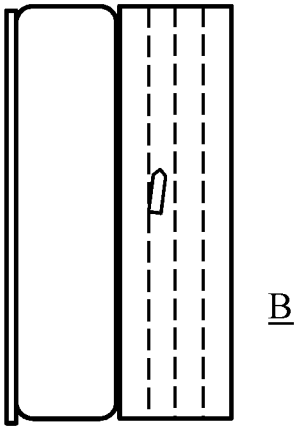

In an embodiment, as illustrated by FIGS. 2A-2C, the outer layer (2) is bound directly to the inner layer (3) or via one or more intermediate layers (not shown). The inner layer can be a laminate (illustrated by the dashed lines) or a monolithic material. The outer surface of the outer layer is preferably provided with a protective layer (5). The projectile-destabilising layer (2) is effective in increasing the yaw-angle of a projectile (1) impacting from the strike face (A). By this effect, the projectile will be less effective in penetrating the projectile-resisting layer (3). Dependent on the projectile, the projectile's impact velocity, and the choice of materials, the projectile will be prevented from penetrating into the projectile-resisting layer (3), penetrate less deeply, or at least (in case of an impact with an extremely high kinetic energy) be substantially slowed down by the projectile-resisting layer (3), such that a living being present on the protected side (B) e.g. an inner space of a vehicle, building or other object is offered protection from impact by a projectile.

Figure 3A:
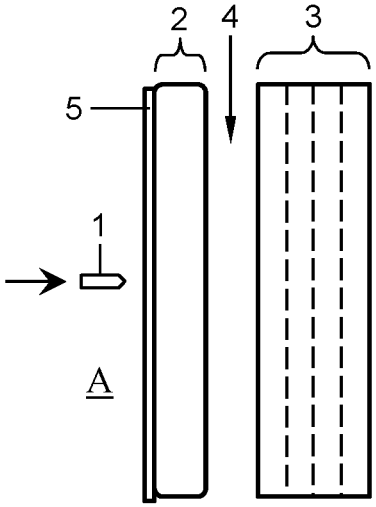
FIGS. 3A-C illustrate the travel path of a projectile through an alternative embodiment of a layered armour system having a protective layer, a projectile destabilising layer, and a projectile-resisting layer.
Figure 3B:
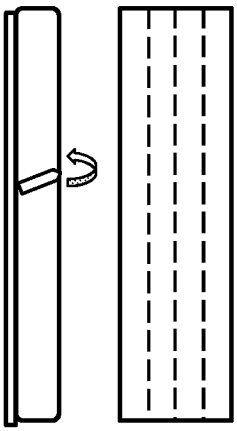
Figure 3C:
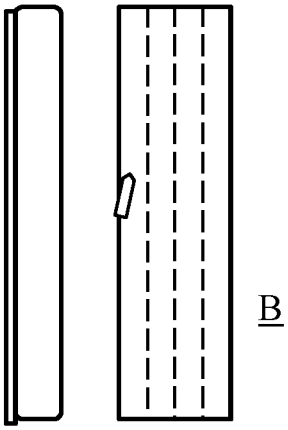

In a further embodiment, e.g. as schematically shown in FIG. 3, a gap (4) is present between the projectile-resisting layer (3) and the projectile-destabilising layer (2). The gap can be open at the sides not defined by both layers (top and bottom as shown in the figure) or closed. The gap can be a vacuum (if closed) or gas-filled space. The gap can provide thermal insulation (as in conventional double glazing; in particular if closed). Moreover, the gap can further contribute to yaw of the projectile, and may in particular act as a yaw-rate generator, as illustrated by the arrow in FIG. 3B. If present, a gap (suitable for contributing to the yaw) usually is at least 10 mm, in particular 10-100 mm, more in particular 10-50 mm.

In an advantageous embodiment, a relatively light-weight armour is provided essentially consisting of polymeric materials. For example, a plate of a known glass laminate effective in resisting a 7.62 AP bullet is about 93 mm thick, having an mass per surface area of about 200 kg/m$^2$. It is envisaged that in accordance with the present invention it is possible to make a laminate of about the same thickness, formed of a bullet-destabilising polymer layer and a bullet-resisting polymer layer, effective in resisting a 7.62 AP (or ball) bullet, or a material (optionally of higher thickness but with the same weight) wherein both of said layers are separated from each other by a gap (vacuum or gas-filled), having a significantly lower areal density (mass per surface area), preferably of less than 150 kg/m$^2$, in particular of about 90 to about 130 kg/m$^2$ more in particular of about 100 to about 120 kg/m$^2$. Further, such embodiment can be composed of transparent polymers, thereby providing a bulletproof window or a transparent wall or door, according to the invention.

Good results have been achieved with a layered armouring system wherein the projectile destabilising layer is the outermost layer. It is possible though to cover the outer surface of the projectile destabilising layer with another layer, e.g. to provide support and/or protect it from wear. Advantageously the layered armouring system is free of a layer designed to absorb the initial impact of a projectile, e.g. free of such a layer as described in US2011/0239851, in particular paragraph [0039]. Thus, advantageously, the layered armouring system is adapted to receive an impacting projectile, such as a 7.62 AP (or ball) bullet at a velocity of 800 m/sec, in the projectile destabilising layer, without a layer being present between the outermost surface and the outer surface of the projectile destabilising layer that is capable of causing a substantial deformation and/or reduction in velocity of such an impacting (metal) projectile.

In an advantageous method for protecting a living being or an object according to the invention the armour system is effective in providing protection without substantially reducing the velocity of an impacting projectile (impacting with a typical velocity at which such projectile operates, and which typically exceeds 100 m/s, e.g. a velocity of about 200 to about 1000 m/s) while passing through the projectile-destabilising layer. Generally, the velocity of a projectile—such as a bullet, in particular an armour piercing bullet—leaving the projectile-destabilising layer (residual velocity) is between 75% and 100%, more in particular between 80% and 99% of the initial impact velocity.

Advantageously in a method of protecting a living being or an object, when an impacting projectile impacts the layered armouring system, it passes through the projectile-destabilising layer without having been substantially deformed prior to entering the projectile-destabilising layer. Further, it advantageously leaves the projectile-destabilising layer without substantial deformation.

The armouring system of the invention can form part of any object of which it is desired to be armoured. In particular, the invention relates to an object comprising the armouring system, wherein the object has an internal space of sufficient size to contain one or more humans, the object having one or more sides that are at least partially formed of said layered armouring material comprising said inner layer (which is closer to the internal space than the outer layer) and the outer layer (which is closer to a strike-face side of the object than the inner layer).

More specifically, the object according to the invention is selected from transports, armaments, shields, fences, walls and buildings.

The invention is now illustrated by the following examples.

EXAMPLES

An armour piercing bullet was shot using 7.62×39 mm munition at a clay block (Roma Plastillina no 1) having a thickness of 61.5 mm. FIGS. 1A and 1B show the bullet and block just before impact and just after leaving the block respectively. Velocity prior to impact was about 200 m/s, after leaving the block about 177 m/s., see table. It is shown that the yaw-angle increased by about 30°. The experiment was repeated at different bullet velocities. Results are shown in the following table.

| Initial velocity [m/s] | Residual velocity [m/s] | Crater diameter [mm] enter-exit | Block thickness [mm] |
|---|---|---|---|
| 198 | 177 | 8.0- | 61.5 |
| 229 | 209 | 8.5- | 61.5 |
| 339 | 319 | 10.5-14 | 61.5 |
| 344 | 324 | 10- | 61.5 |
| 415 | 386 | 12- | 61.5 |

The example was repeated with ballistic gelatine, a change in yaw angle was observed.

The example was repeated with a water-filled tube, a change in yaw angle of more than 90° was observed.

The invention claimed is:

1. An armoured object selected from the group consisting of transports, armaments, shields, fences, walls and buildings, said object having one or more sides that are at least partially formed of a layered armouring system comprising at least an inner layer and an outer layer closer to a strike face than the inner layer, which inner layer is a projectile-resisting layer having an E-modulus of 1 GPa or more, and the outer layer is a projectile-destabilising layer selected from the group consisting of clays, waxes and gels or selected from the group consisting of fluid materials, plastic (malleable) materials and gels provided in a container material, which projectile-destabilising layer has a lower E-modulus than the projectile-resisting layer, and which projectile-destabilising layer has a Hooke number defined as $\rho \cdot v^2/E$, ρ being the density in $kg/m^3$; v being the projectile velocity in m/s and E being the E-modulus of the projectile-destabilising layer in $kg/m \cdot s^2$, wherein the Hooke number is at least 1.0 at a projectile velocity (v) of 800 m/sec.

2. The armoured object according to claim 1, wherein the object is a transport, armament or building having an internal space of sufficient size to contain one or more humans, the object having one or more sides that are at least partially formed of said layered armouring system comprising said inner layer which is closer to an internal space of the transport, armament or building than the outer layer.

3. The armoured object according to claim 1, wherein said Hooke number of the projectile-destabilising layer is at least about 5.

4. The armoured object according to claim 1, wherein the projectile-destabilising layer has a thickness of at least 5 mm.

5. The armoured object according to claim 1, wherein the projectile-resisting layer has a thickness of at least 2 mm.

6. The armoured object according to claim 1, wherein a vacuum or gas-filled gap is present between the inner layer and the outer layer.

7. The armoured object according to claim 1, wherein the outer layer is attached directly to the inner layer or via one or more intermediate layers.

8. The armoured object according to claim 1, wherein the projectile-destabilising layer is a polymeric material.

9. The armoured object according to claim 1, wherein the armouring system is essentially transparent.

10. The armoured object according to claim 1, wherein the strike face of the layered armouring system is free of a layer designed to absorb the initial impact of a projectile.

11. The method of claim 1, wherein the density ρ of the projectile-destabilising layer is in the range of 500-2000 $kg/m^3$.

12. The method of claim 1, wherein the total projectile-destablising layer has a maximum thickness of about 100 mm.

13. A method for protecting a living being or a thing from damage by a projectile, wherein a layered armouring material is positioned between the living being or thing and the projectile or the direction from which the risk of impact by the projectile is expected, wherein the armouring system, comprises at least an inner layer and an outer layer closer to a strike face than the inner layer, which inner layer is a projectile-resisting layer having an E-modulus of 1 GPa or more, and the outer layer is a projectile-destabilising layer selected from the group consisting of clays, waxes and gels or selected from the group consisting of fluid materials, plastic (malleable) materials and gels provided in a container material, which projectile-destabilising layer has a lower E-modulus than the projectile-resisting layer, which projectile-destabilising layer has a Hooke number defined as $\rho \cdot v^2/E$, ρ being the density in $kg/m^3$; v being the projectile velocity in m/s and E being the E-modulus of the projectile-destabilising layer in $kg/m \cdot s^2$ , wherein the Hooke number is at least 1.0 at a projectile velocity (v) of 800 m/sec.

14. The method according to claim 13, wherein the projectile-destabilising layer has a thickness of at least 5 mm and wherein the projectile-resisting layer has a thickness of at least 2 mm.

15. The method according to claim 13, wherein the projectile-destabilising layer is a polymeric material selected from the group consisting of acrylonitrile-butadiene-styrene; acetal resins; cellulose derivatives; acrylics, allyl resins; polyethers ; fluoroplastics; melamines; polyamides; parylene polymers; phenolics; phenoxy resins; polybutylene, polycarbonates; polyesters; polyolefines; polyphenylenes; polystyrenes, polyurethanes; polyurea;

polysulphones; polyvinyl alcohols; polyvinyl fluorides; polyvinyl butyrals; polyvinylidene chlorides, silicones; styrene acrylonitrides; styrene butadiene; polyvinylchlorides; and gelatin, and copolymers thereof.

16. The method according to claim 13, wherein the armouring system is essentially transparent.

17. The method of claim 13 wherein the projectile is a bullet or a Stanag 4569 level 3 armour piercing projectile.

18. The method according to claim 13, wherein the projectile-destabilising layer has a thickness of at least 5 mm and when a Stanag 4569 level 3 armour piercing projectile penetrates into and passes through the projectile-destabilising layer, it does so without being substantially reduced in velocity while passing through the projectile-destabilising layer.

19. The method according to claim 13, wherein the projectile-destabilising layer has a thickness of at least 5 mm and when a Stanag 4569 level 3 armour piercing projectile impacts the layered armouring system, it passes through the projectile-destabilising layer without having been substantially deformed prior to entering the projectile-destabilising layer.

20. The method of claim 13 wherein the yaw-angle or angular velocity of the projectile impacting on a projectile resisting structure is increased.

21. The method of claim 13, wherein the total projectile-destablising layer has a maximum thickness of about 100 mm.

* * * * *